US005503501A

United States Patent [19]

Kunito

[11] Patent Number: 5,503,501

[45] Date of Patent: Apr. 2, 1996

[54] EXCAVATOR AND A METHOD OF FORMING A MODIFIED GROUND IN AN EARTHEN FOUNDATION WITH THE USE OF THE SAME

[75] Inventor: Mitsuhiro Kunito, Kishiwada, Japan

[73] Assignee: Kabushiki Kaisha Ask Kenkyusho, Osaka, Japan

[21] Appl. No.: 329,902

[22] Filed: Oct. 27, 1994

[30] Foreign Application Priority Data

Mar. 1, 1994 [JP] Japan ..... 6-031525

[51] Int. Cl.[6] ..... E02D 3/12

[52] U.S. Cl. ..... 405/241; 405/237; 405/269

[58] Field of Search ..... 405/233, 236, 405/237, 240, 241, 242, 248, 269; 175/267

[56] References Cited

U.S. PATENT DOCUMENTS

| | | | |
|---|---|---|---|
| 4,433,943 | 2/1984 | Pao Chen | 405/241 |
| 4,624,606 | 11/1986 | Nakanishi et al. | 405/269 |
| 4,786,212 | 11/1988 | Bauer et al. | 405/269 |
| 4,906,142 | 3/1990 | Taki et al. | 405/241 X |
| 5,256,004 | 10/1993 | Gemmi et al. | 405/237 |
| 5,399,056 | 3/1995 | Shibazaki et al. | 405/233 |
| 5,411,353 | 5/1995 | Taki | 405/241 |

FOREIGN PATENT DOCUMENTS

| | | | |
|---|---|---|---|
| 119024 | 9/1981 | Japan | 405/240 |
| 33641 | 2/1983 | Japan | 405/240 |
| 154214 | 9/1984 | Japan | 405/240 |
| 62333 | 4/1985 | Japan | 405/241 |
| 125017 | 5/1990 | Japan | 405/241 |
| 212506 | 9/1991 | Japan | 405/241 |

*Primary Examiner*—John A. Ricci

*Attorney, Agent, or Firm*—Armstrong, Westerman, Hattori, McLeland & Naughton

[57] ABSTRACT

A modified ground, for example, an underground water cut-off wall, landslide protection wall, or the like, is formed in an earthen foundation with the use of an excavator having at least one rotary shaft. The rotary shaft comprises a bit provided at a bottom end thereof, a stirrer having an expandable stirring wing disposed upwardly of the bit, and at least one nozzle for jetting a consolidating fluid in a downwardly diagonal direction. The stirring wing is capable of selectively taking an expanded form and a reduced form to vary an outside diameter of the stirrer about the axis of the rotary shaft. The nozzle is disposed upwardly of the stirrer such that the consolidating fluid jetted from the nozzle collides with the stirring wing in the expanded form. In the present method, the rotary shaft is inserted at a predetermined depth in the earthen foundation to form a hole therein while keeping the stirring wing in the reduced form without jetting the consolidating fluid from the nozzle. Subsequently, the rotary shaft is withdrawn away from the hole while rotating the rotary shaft, keeping the stirring wing in the expanded form, and jetting the consolidating fluid from the nozzle against soil surrounding the hole for enlarging the diameter of the hole in such a manner as to perform an in-situ mixing and stirring of the consolidating fluid and soil. After the resulting mixture is hardened, the modified ground having a larger diameter than the hole is formed in the earthen foundation.

5 Claims, 15 Drawing Sheets

2
50
17
14
13
60

2
50
17
14
13
60

2
50
17
15
51
60

2
17
15
60
51

51

2C
50C
2C
50C
17C
70C
71C
60C
13C
14C
13C
14C 50C
53C
S
50C 2C
17C
70C
71C
61C
60C
13C
15C
60C
60C
51C 50C
51C
53C

51C

EXCAVATOR AND A METHOD OF FORMING A MODIFIED GROUND IN AN EARTHEN FOUNDATION WITH THE USE OF THE SAME

BACKGROUND OF THE INVENTION

1. Field of the Invention

The present invention relates to an improved excavator and a method of forming a modified ground in an earthen foundation with the use of the excavator, and more particularly a method of constructing an underground water cut-off wall, landslide protection wall, a foundation pile or the like, in the earthen foundation.

2. Disclosure of the Prior Art

In the prior art, Japanese Patent Early Publication [KOKAI] No. 05-346020 teaches that a modified ground is formed in an earthen foundation by applying a mechanical stirring and an injection of a consolidating fluid. As shown in FIG. 22, this method utilizes an excavator having a rotary shaft 2H. The rotary shaft 2H has a pair of stirring wings 60H which are spaced away from each other axially of the rotary shaft 2H. Each of the stirring wings 60H is provided with a nozzle 15H for jetting the consolidating fluid. The stirring wings 60H are also disposed on the rotary shaft 2H such that the consolidating fluid jetted from one of the nozzles 15H collides with that jetted from the other nozzle.

The modified ground of this prior art is composed of a core pile P1 having a diameter D1 and a ring pile P2 having an outer diameter D2. The core pile P1 is formed by stirring and mixing an excavated soil with the consolidating fluid jetted from a nozzle 14H of the rotary shaft with the stirring wings 60H. At the same time, the ring pile P2 is formed by jetting the consolidating fluid from the nozzles 15H against soil surrounding the core pile P1.

However, when the consolidating fluid jetted from one of the nozzles 15H is intercepted by an obstacle such a rock prior to colliding with that jetted from the other nozzle, it would be difficult to obtain a sufficient mixing and stirring of the consolidating fluid and soil in the ring pile P2, and precisely form the ring pile P2 having the diameter D2.

In addition, a mixing state of the excavated soil with the consolidating fluid in the core pile P1 would be different from the mixture state in the ring pile P2 because the soil in the core pile P1 is mixed with the consolidating fluid mainly by the stirring wings 60H, and on the other hand the soil in the ring pile P2 is excavated mainly by the consolidating fluid jetted from the nozzles 15H without utilizing the stirring wings 60H. As a result, it would be difficult to uniformly form the modified ground as a whole in the earthen foundation.

Moreover, when a joined jet of the consolidating fluid, which is generated by collision of the consolidating fluid jetted from the nozzles 15H, advances in a horizontal or upwardly diagonal direction, there is a probability of causing upheavals on the ground or blowing the soil to the outside of the modified ground by the joined jet. In particular, when thus blown soil hits the worker, it would give a serious injury to the worker.

SUMMARY OF THE INVENTION

For improving the above problems, the present invention is directed to an improved excavator, and a method of forming a modified ground pillar or wall in an earthen foundation with the use of the excavator. The excavator has at least one rotary shaft which includes a bit provided at a working or bottom end thereof, a stirrer having at least one expandable stirring wing disposed upwardly of the bit, and at least one nozzle for jetting a consolidating fluid in a downwardly diagonal direction. The stirring wing is capable of selectively taking an expanded form and a reduced form to vary an outside diameter of the stirrer about the axis of the rotary shaft. The nozzle is disposed upwardly of the stirrer such that the consolidating fluid jetted therefrom collides with the stirring wing in the expanded form.

The modified ground pillar can be formed uniformly with the use of the excavator according to the following method. The rotary shaft is inserted at a predetermined depth in the earthen foundation to form therein a hole while keeping the stirring wing in the reduced form without jetting the consolidating fluid from the nozzle. Subsequently, the rotary shaft is withdrawn away from the bottom of the hole while rotating the rotary shaft, keeping the stirring wing in the expanded form, and jetting the consolidating fluid from the nozzles against soil surrounding the hole to break the same for enlarging the diameter of the hole in such a manner as to perform an in-situ mixing and stirring of the consolidating fluid and soil. As a result, the modified ground pillar having a larger diameter than the hole can be formed uniformly in the earthen foundation. In the withdrawing step of the present invention, even when the consolidating fluid jetted from the nozzles is intercepted by an obstacle such as a hard clod of earth prior to colliding with the stirring wings in the expanded form, so that a small amount of soil which is not broken by the consolidating fluid remains around the hole 50 in the earthen foundation, it is possible to break the remains of soil with the stirring wings 61 in the expanded form. Thus, the modified ground pillar 51 having a desired diameter can be precisely formed in the earthen foundation. In addition, since the consolidating fluid is always jetted in a diagonally downward direction, it is possible to continue the withdrawing step even at the periphery of an entrance of the hole 50 safely without causing upheavals of the earthen foundation or blowing the soil to the outside of the hole by the jet of the consolidating fluid.

Therefore, it is a primary object of the present invention is to provide an improved excavator, and a method of forming a modified ground safely and precisely in an earthen foundation with the use of the excavator.

It is also preferred that an excavator having a plurality of rotary shafts is utilized for efficiently forming the modified ground wall in the earthen foundation. Each of the rotary shafts is the substantially same as the above explained rotary shaft. In this case, the excavating step is performed such that the hole excavated by each of said rotary shafts is not overlapped with the hole excavated by an adjacent rotary shaft. The withdrawing step is then performed such that a stirring and mixing range given by the consolidating fluid jetted from the nozzle and the stirring wing in the expanded form of each of the rotary shafts is partially overlapped with the stirring and mixing range of the adjacent rotary shaft to form the modified ground wall.

Other features, objects and advantages of the present invention will become more apparent from the following description and the attached drawings about the preferred embodiments.

DESCRIPTION OF THE PREFERRED EMBODIMENTS

<First Embodiment>

Figure 1:
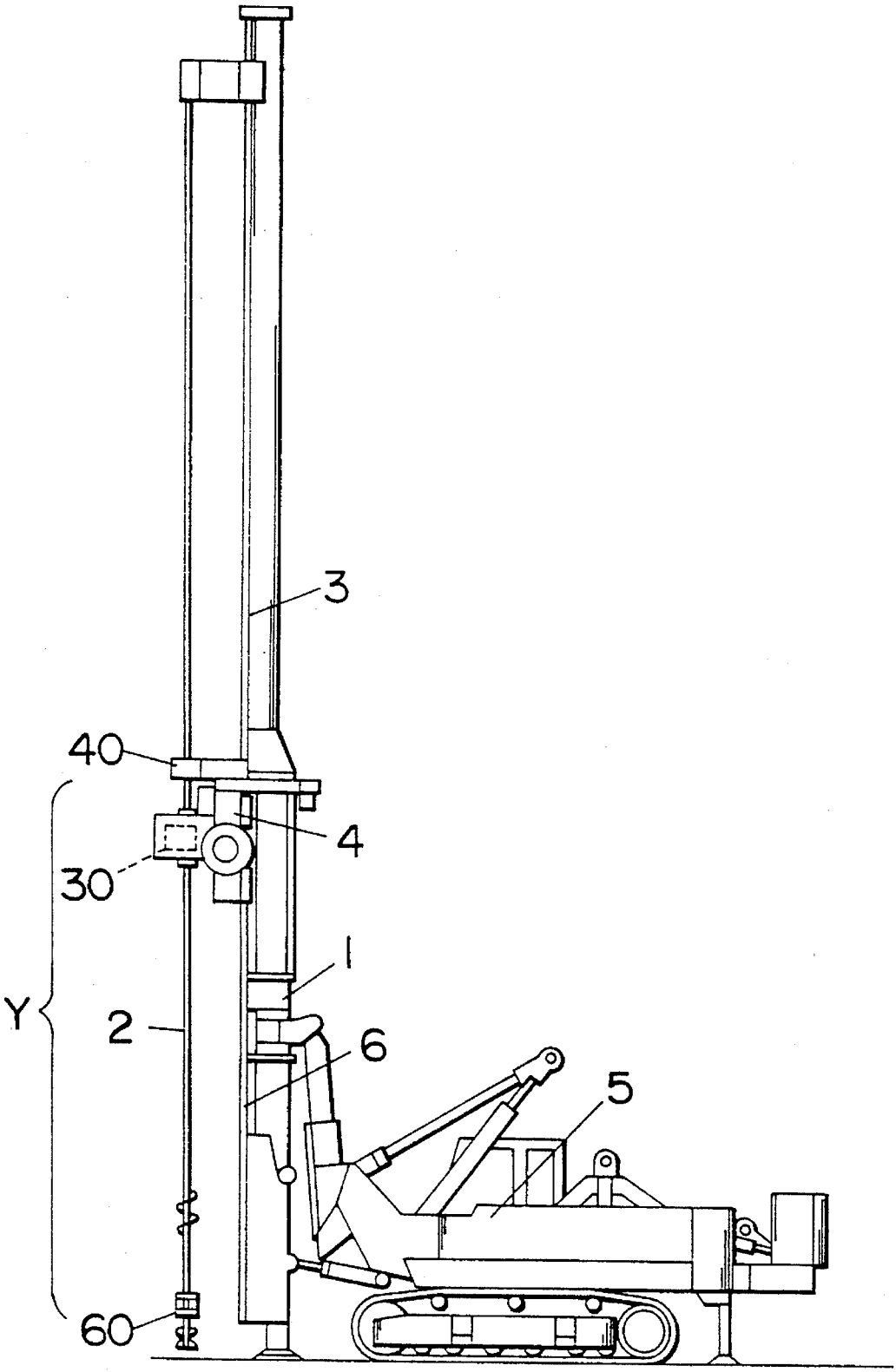
FIG. 1 is an overall side view of an excavator used in a first embodiment of the present invention.

FIG. 1 shows an excavator 1 used in this embodiment, which is fixed on an earthen foundation. The excavator 1 comprises an auger shaft 2, a tower 3 vertically stood on the earthen foundation, a movable housing 4 for incorporating a driving device of the auger shaft 2 and a main chucking device 30 for rotatably chucking the auger shaft 2, and an operation unit 5 of the excavator 1. The movable housing 4 is moved upwardly and downwardly along a guide rail 6 of the tower 3 within a vertical travel shown by the range "Y" of FIG. 1 by the use of a wire or chain. The excavator 1 further includes an auxiliary chucking device 40 of the auger shaft 2 which is disposed in the vicinity of a top end position of the vertical travel "Y".

Figure 2:
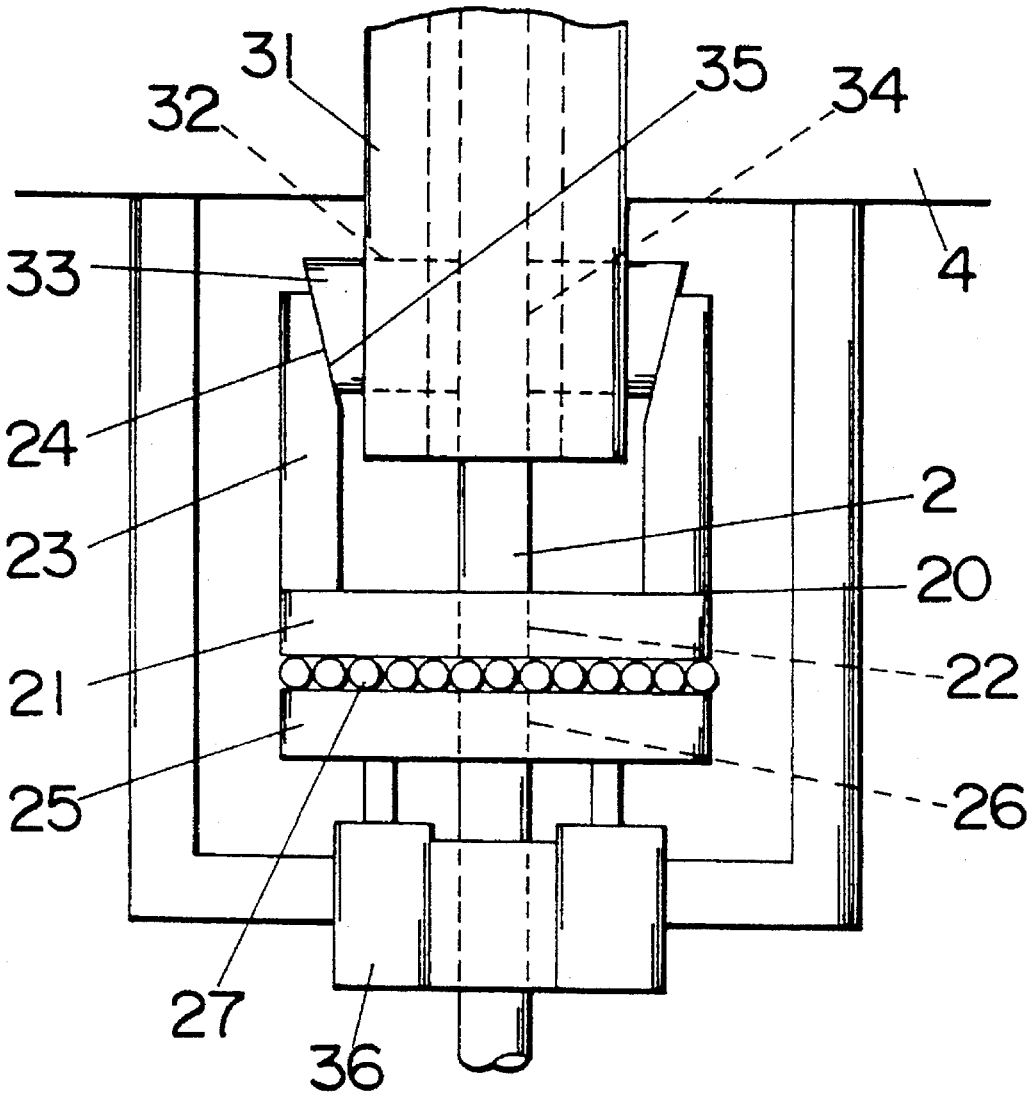
FIG. 2 is a plan view of a main chucking device of an auger shaft of the excavator.
Figure 3:
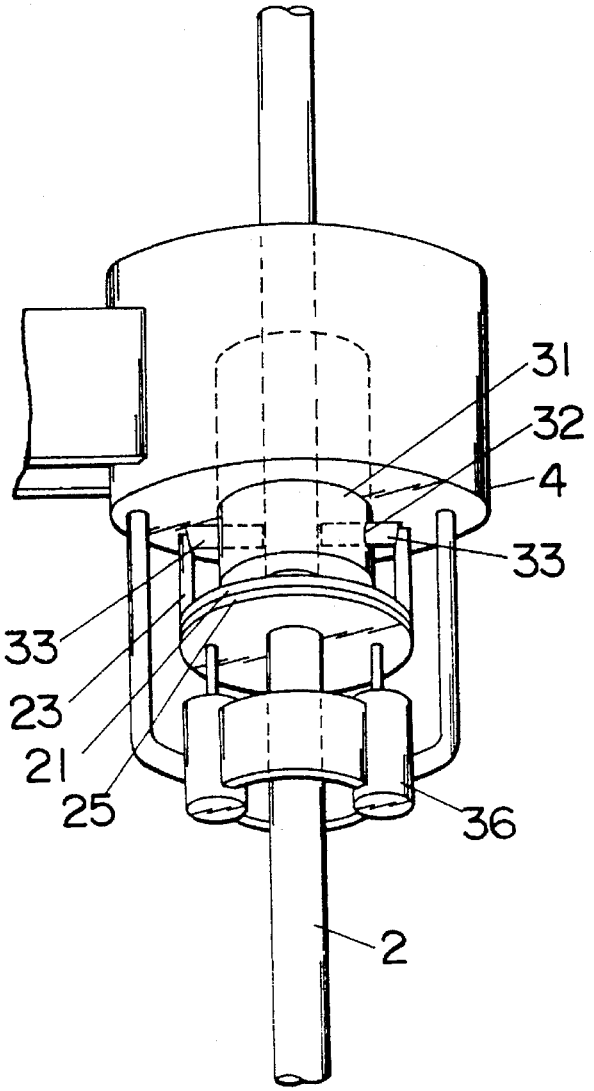
FIG. 3 is a perspective view of the main chucking device.

As shown in FIGS. 2 and 3, the auger shaft 2 passes through a rotary cylinder 31 and slidably contacts with the inner surface of the rotary cylinder 31. The rotary cylinder 31 is rotated by the driving device, and is provided with a pair of horizontal through-holes 32 extending in a diametral direction thereof. Chucking arms 33 are respectively put in the horizontal through-holes 32 slidably in the diametral direction of the rotary cylinder 31. The auger shaft 2 can be chucked between vertical ends 34 of the chucking arms 33. Inclined ends 35 of the chucking arms 33 are respectively projected from the horizontal through-holes 32 outwardly.

A coupling member 20 is formed with a disc 21 having a center through-hole 22 for the auger shaft 2 and a pair of vertical arms 23 extending on the disc 21. Tapered ends 24 of the vertical arms 23 slidably contact with the inclined ends 35 of the chucking arms 33, respectively. A disc table 25 having a center through-hole 26 for the auger shaft 2 is moved upwardly or downwardly by a pair of hydraulic lifter 36 disposed at the periphery of the auger shaft 2. A ball bearing 27 is arranged between the disc 21 and the disc table 25 such that the coupling member 20 can be rotated about the auger shaft 2 on the disc table 25. Therefore, as the disc table 25 is moved upwardly or downwardly by the hydraulic lifter 36, the coupling member 20 is also moved upwardly or downwardly together with the ball bearing 17.

As the coupling member 20 is moved upwardly by the hydraulic lifter 36, the inclined ends 35 of the chucking arms 33 respectively slide on the tapered ends 24 of the vertical arms 23 so as to close a distance between the vertical ends 34 of the chucking arms 33. As a result, the auger shaft 2 is tightly chucked between the chucking arms 33. When the rotary cylinder 31 is rotated by the driving device, the rotation of the rotary cylinder 31 is transmitted to the auger shaft 2 through the chucking arms 33. Though the rotation of the rotary cylinder 31 is also transmitted to the coupling member 20 through the chucking arm 33, the coupling member 20 can rotate together with the augur shaft 2 with the help of the ball bearing 27, as described above. Therefore, the auger shaft 2 can be advanced to or withdrawn from the earthen foundation while rotating the auger shaft 2 by moving the movable housing 4 downwardly or upwardly.

Figure 4:
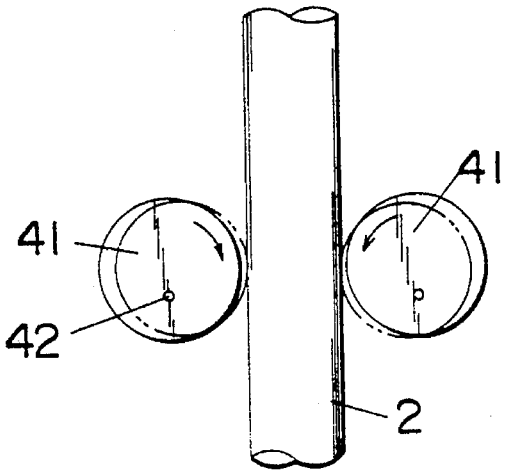
FIG. 4 explains a chucking method of an auxiliary chucking device of the auger shaft.

On the contrary, when the coupling member 20 is moved downwardly by the hydraulic lifter 36, the chucking of the auger shaft 2 with the vertical ends 34 of the chucking arms 33 is released. Therefore, since the rotation of the rotary cylinder 31 is not transmitted to the auger shaft 2, it is possible to move the movable housing 4 upwardly or downwardly without transferring the auger shaft 2. In particular, it is preferred that the auger shaft 2 is chucked with the auxiliary chucking device 40 for stably supporting the auger shaft 2 when the chucking of the auger shaft 2 with the main chucking device 30 is released. For example, the auxiliary chucking device 40 is formed with a pair of chucking members 41 each of which has an eccentric axis 42. When each of the chucking members 41 is rotated about the eccentric axis 42, as indicated by the arrows of FIG. 4, so as to close a distance between the chucking members 41, the auger shaft 2 is hold by the chucking members 41.

Figure 5:
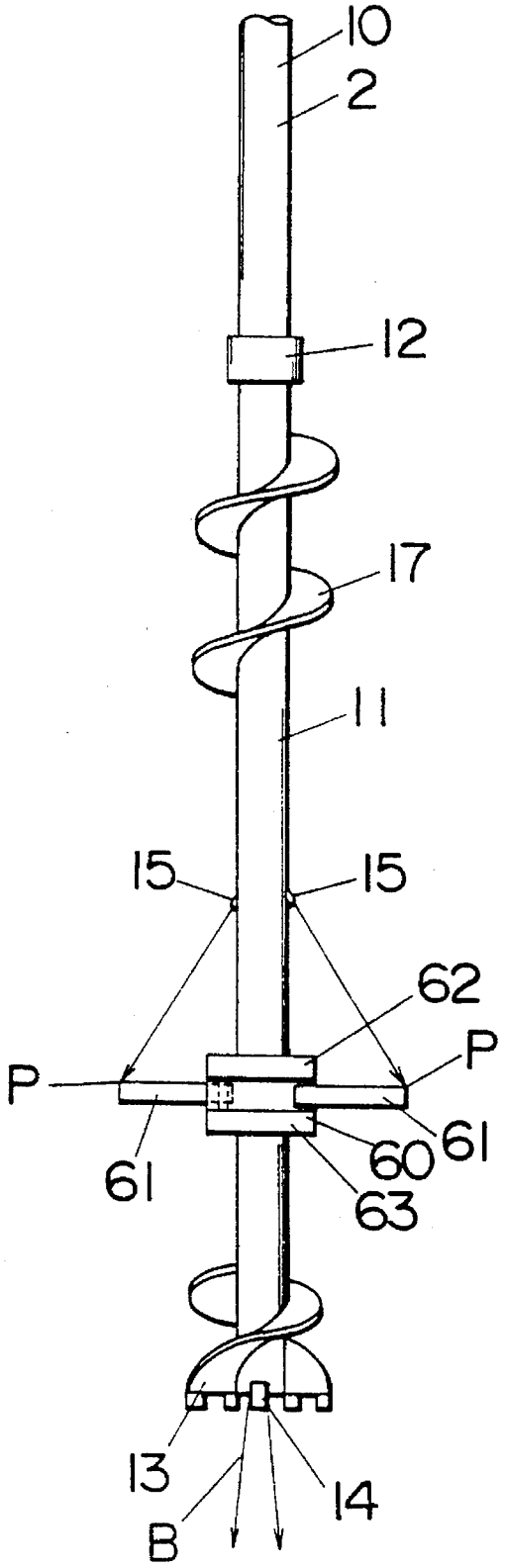
FIG. 5 is a front view of an auger shaft of the present invention.

As shown in FIG. 5, the auger shaft 2 is composed of a lower rod 11, an upper rod 10 for reaching the lower rod 11 to a predetermined depth in the earthen foundation, and a joint 12 connecting between the upper rod 10 and lower rod 11. The lower rod 11 is formed with a bit 13 provided at a working or bottom end thereof, a nozzle 14 for jetting a fluid, a pair of nozzles 15 for jetting a consolidating fluid in a downwardly diagonal direction, a stirrer 60 having a pair of expandable stirring wings 61 and a spiral screw 17. The fluid is jetted from the nozzle 14, as shown by the arrows "B" of FIG. 5, in order to facilitate the progress of the auger shaft 2 into the earthen foundation. For example, a diluted cement milk or a mixture solution of cement milk, bentonite, and the like, is used as the fluid. The nozzles 15 are provided in the auger shaft 2 upwardly of the stirrer 60. A cement milk, a mixture solution the main ingredient of which is the cement milk or a synthetic resin solution, or the like, is used as the consolidating fluid. The stirring wings 61 of the stirrer 60 are capable of selectively taking an expanded form and a reduced form to vary an outside diameter of the stirrer 60 about the axis of the shaft 2. The stirrer 60 is provided on the augur shaft 2 such that the consolidating fluid jetted from the nozzles 15 collides with the stirring wings 61 in the expanded form. In FIG. 5, "P" designates a collision point of the consolidating fluid with the stirring wing 61.

Figure 10:
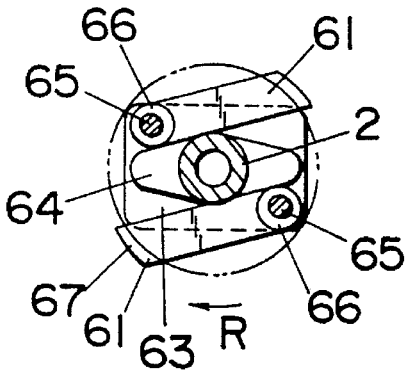
FIG. 10 is a transversely cross-sectional view of a stirrer with an expandable stirring wing in a reduced form.
Figure 11:
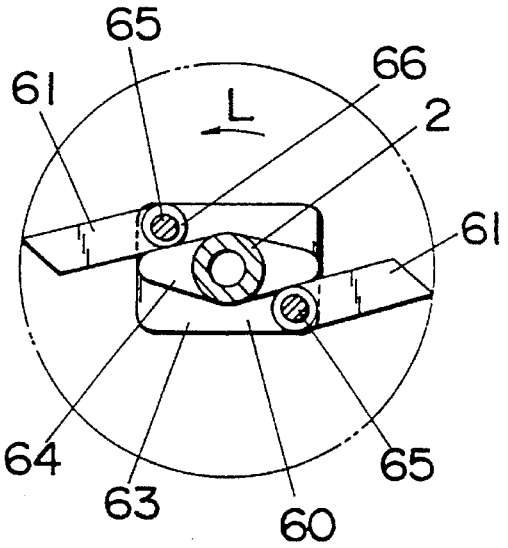
FIG. 11 is a transversely cross-sectional view of the stirrer in an expanded form.

As shown in FIGS. 10 and 11, the stirrer 60 is formed with the stirring wings 61, top and bottom flanges (62 and 63) each of which is in a substantially rectangular shape, and a barrel portion 64 having a shape like a rhombic prism which is disposed between the top and bottom flanges (62 and 63). A pair of pins 65 extends from the opposed corners of the top flange 62 to the corresponding corners of the bottom flange 63. Pivot ends 66 of the stirring wings 61 are respectively engaged with the pins 65 such that each of the stirring wings 61 can pivot about the pin 65 to make the expanded form or reduced form of the stirrer 60. It is preferred that a free end of the stirring wing 61 is provided with a cutting head 67 for enhancing the withdrawing step. When the stirrer 60 in the reduced form is rotated clockwise about the axis of the auger shaft 2, as indicated by the arrow "R" of FIG. 10, the stirring wings 61 respectively pivot counterclockwise about the pins 65 to make the expanded form of the stirrer 60, as shown in FIG. 11. On the contrary, when the stirrer 60 in the expanded form is rotated counterclockwise about the axis of the auger shaft 2, as indicated by the arrow "L" of FIG. 11, the stirring wings 61 respectively pivot clockwise about the pins 65 to make the reduced form thereof, as shown in FIG. 10.

Figure 12:
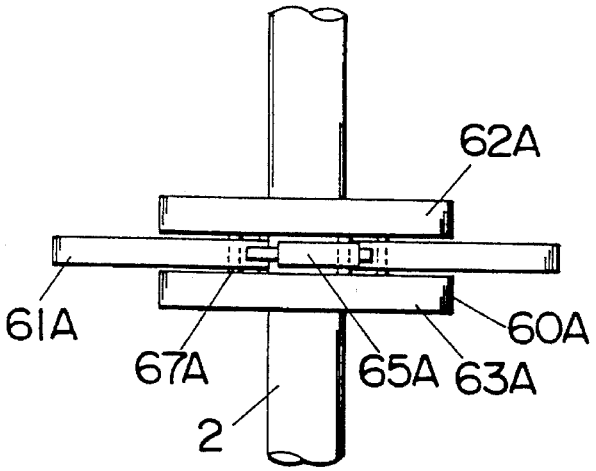
FIG. 12 is a front view of another stirrer with an expandable stirring wing in an expanded form.
Figure 13:
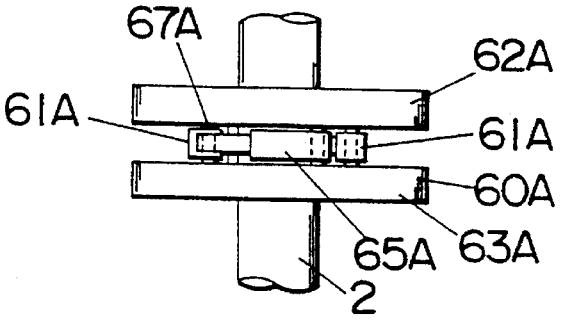
FIG. 13 is a front view of the stirrer of FIG. 12 in a reduced form.
Figure 14:
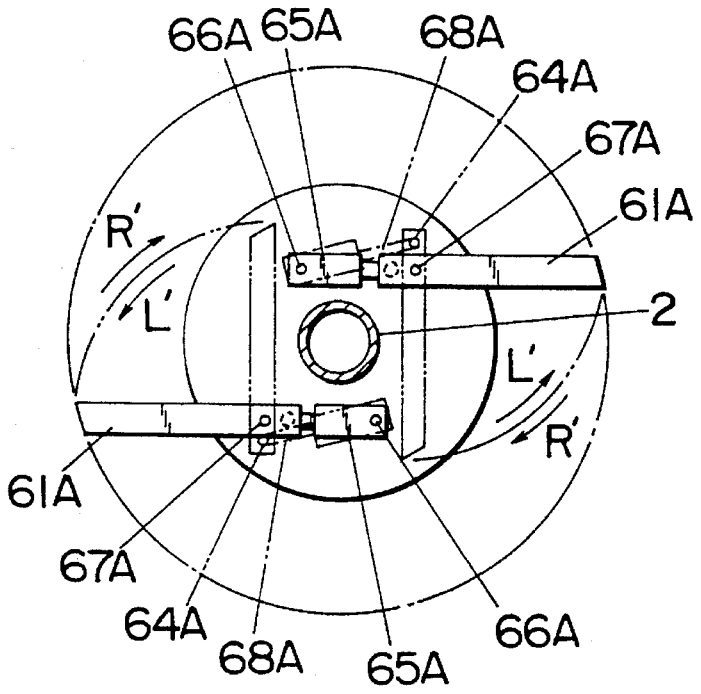
FIG. 14 explains how to expand or reduce the stirrer of FIG. 12.

It is further preferred that the auger shaft 2 has a stirrer 60A in place of the above stirrer 60, as shown in FIGS. 12 to 14. The stirrer 60A comprises a pair of folding units, and top and bottom discs (62A and 63A) each of which has a center through-hole for the auger shaft 2. Each of the folding unit includes a stirring wing 61A having a joint portion 64A at one end thereof, an oil pressure device 65A, a first pin 66A for allowing the oil pressure device 65A to pivot about the first pin 66A, and a second pin 67A for allowing the stirring wing 61A to pivot about the second pin 67A. The first and second pins (66A and 67A) of one folding unit are respectively positioned in a central-symmetrical relation about the axis of the auger shaft 2 with those pins of the other folding unit. An extendible cylinder 68A of the oil pressure device 65A is jointed with the joint portion 64A of the stirring wing 61A such that when the extendible cylinder 68A is reduced by the oil pressure device 65A, the stirring wing 61A can pivot counterclockwise about the second pin 67A, as indicated by the arrow L' of FIG. 14, to obtain an expanded form of the stirrer 60A of FIG. 12, and on the contrary, when the extendible cylinder 68A is expanded by the oil pressure device 65A, the stirring wing 61A can pivot clockwise about the second pin 67A, as indicated by the arrow R' of FIG. 14, to obtain a reduced form of the stirrer 60A of FIG. 13. In FIG. 14, a dotted line of the stirring wing 61A designates the reduced form of the stirrer 60A, and a solid line thereof designates the expanded form of the stirrer 60A.

Figure 15:
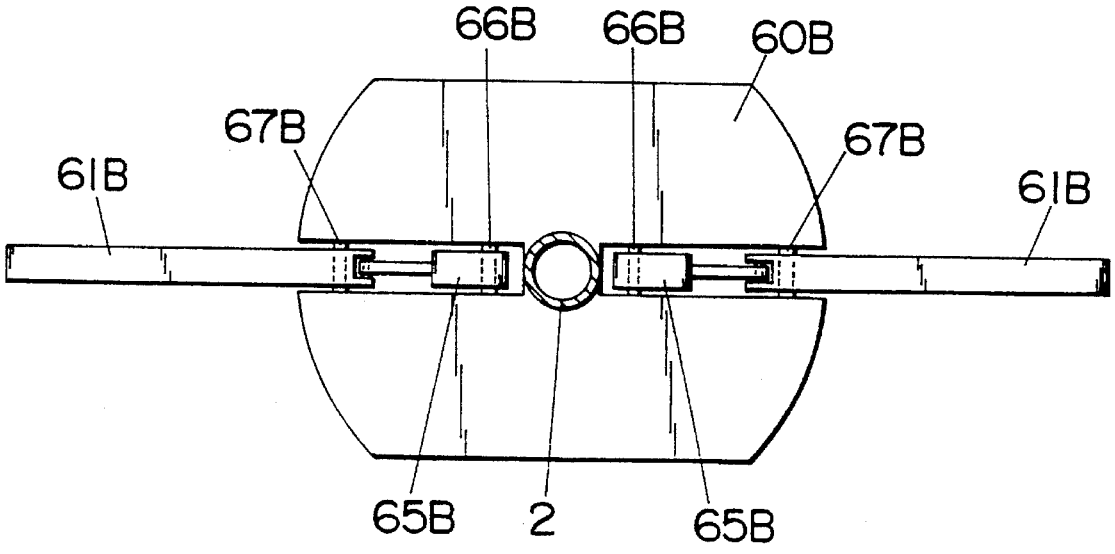
FIG. 15 is a transversely plane view of still another stirrer with an expandable stirring wing in an expanded form.
Figure 16:
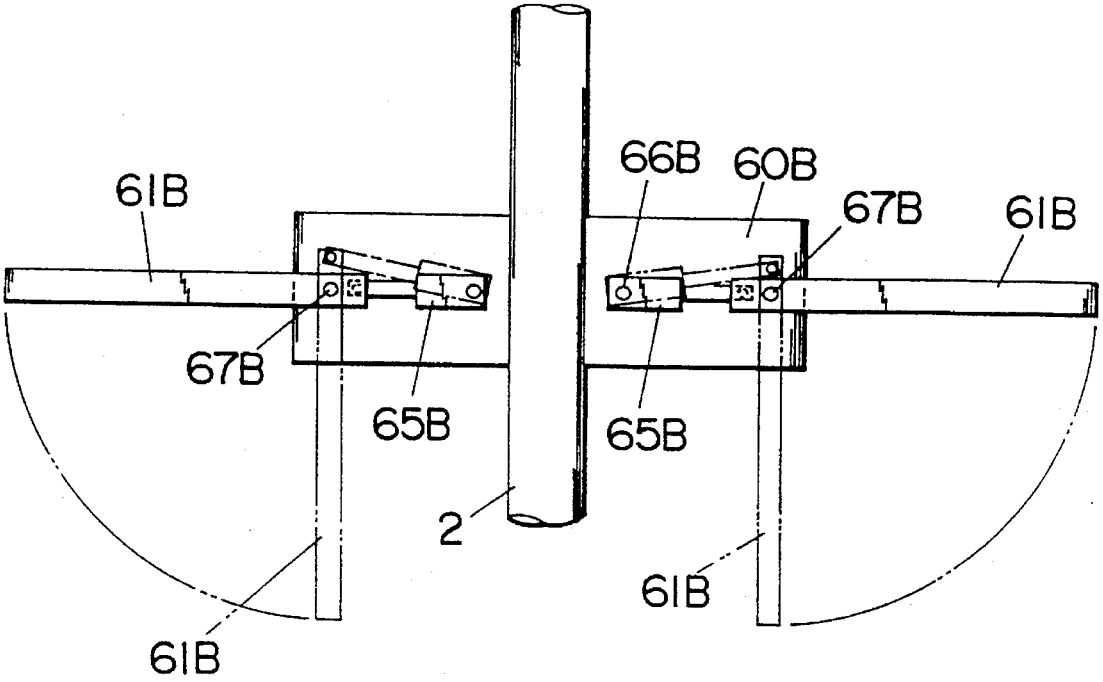
FIG. 16 explains how to expand or reduce the stirrer of FIG. 15.

It is still further preferred that the auger shaft 2 has a stirrer 60B in place of the above stirrer 60, as shown in FIGS. 15 and 16. Stirring wings 61B of the stirrer 60B can be expanded or reduced in accordance with the substantially same manner as the stirring wings 61A except that the stirring wings 61B are moved along a vertical plane including the axis of the auger shaft 2, as shown in FIG. 16. In FIG. 16, a dotted line of the stirring wing 61B designates a reduced form of the stirrer 60B, and a solid line thereof designates an expanded form of the stirrer 60B.

Figures 6A, 6B, 6C, 6D, 6E:
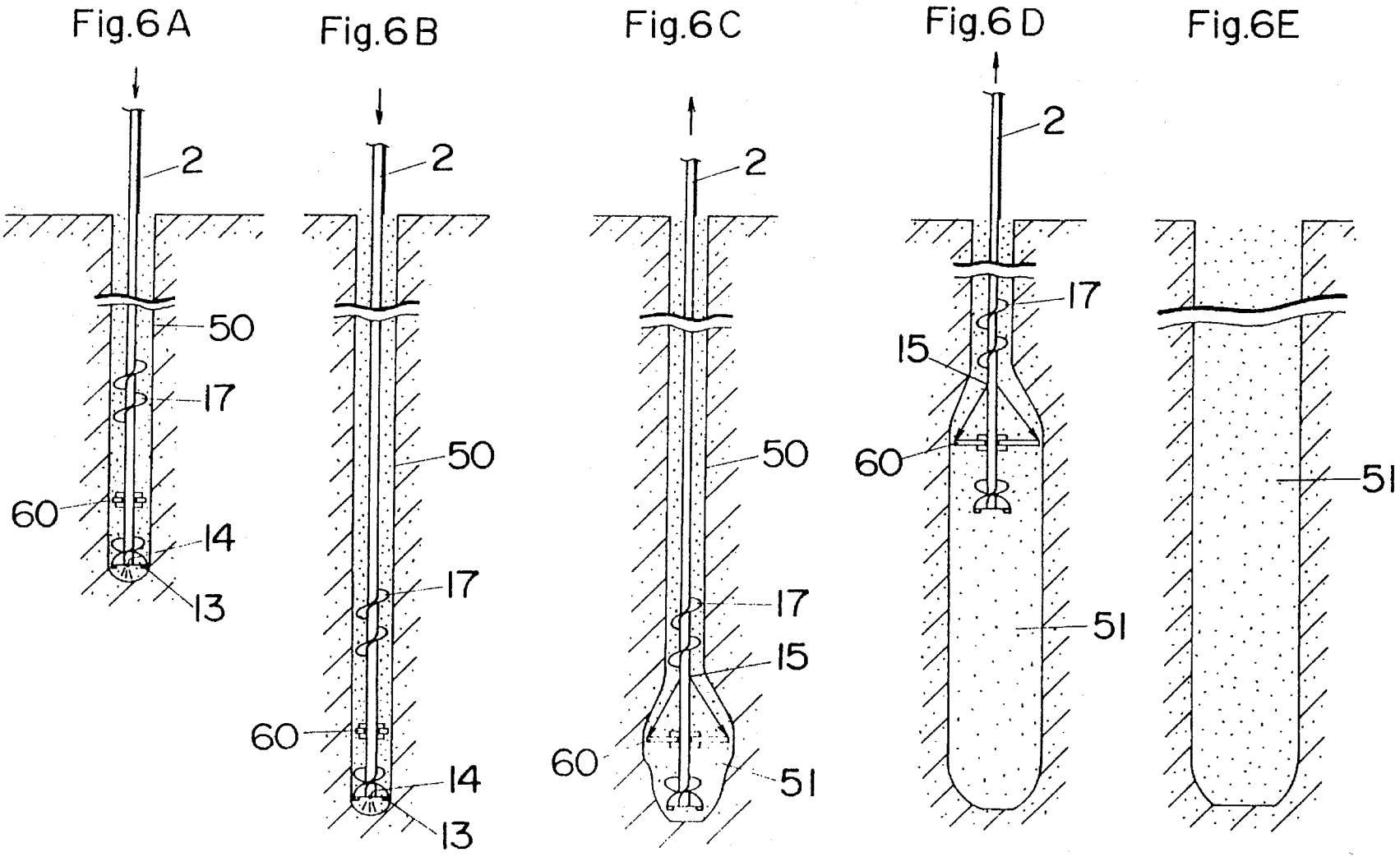
FIGS. 6A to 6E show a process of forming a modified ground pillar in an earthen foundation with the use of the auger shaft of FIG. 5.

By the use of the above explained excavator 1, a modified ground pillar 51 can be formed in an earthen foundation in accordance with the following method of the present invention. That is, the present method comprises an excavating step, as shown in FIGS. 6A and 6B, and a withdrawing step of the auger shaft 2, as shown in FIGS. 6C to 6E. In the excavating step, the earthen foundation is excavated with the bit 13 to form therein a hole 50 by rotating the auger shaft 2 while jetting the fluid from the nozzle 14 and keeping the stirring wings 61 in the reduced form without jetting the consolidating fluid from the nozzles 15 until the hole 50 having a predetermined depth is formed, as shown in FIG. 6B. The spiral screw 17 is useful to keep the excavated soil softly in the hole 50 during the excavating step. In addition, since a part of the excavated soil is exhausted to the outside of the hole 50, it is possible to prevent an overflow of an excess amount of the fluid from the hole 50.

In the withdrawing step, the auger shaft 2 is withdrawn away from the bottom of the hole 50 without jetting the fluid from the nozzle 14 and while rotating the auger shaft 2, keeping the stirring wings 61 in the expanded form, and jetting the consolidating fluid from the nozzles 15 against soil surrounding the hole 50 to break the same for enlarging the diameter of the hole 50 in such a manner as to perform an in-situ stirring and mixing of the consolidating fluid and the soil, so that the modified ground pillar 51 having a larger diameter than the hole 50 is formed in the earthen foundation, as shown in FIG. 6E. Since the consolidating fluid is always jetted in a diagonally downward direction, it is possible to continue the withdrawing step even at the periphery of the entrance of the hole 50 safely without causing upheavals of the earthen foundation or blowing the soil to the outside of the hole by the consolidating fluid. The diameter of the modified ground pillar 51 is substantially equal to that of the stirrer 60 in the expanded form.

In the present method, since the soil surrounding the hole 50 is first broken by the consolidating fluid jetted from the nozzles 15, it is possible to decrease an impulsive load accidentally given to the stirrer 60 during the withdrawing step. Therefore, the withdrawing step can be efficiently performed without causing a breakage of the stirrer 60. In addition, even when the consolidating fluid jetted from the nozzles 15 is intercepted by an obstacle such as a hard clod of earth prior to colliding with the stirring wings 61 in the expanded form, so that a small amount of soil which is not broken by the consolidating fluid remains around the hole 50 in the earthen foundation, it is possible to break the remains of soil with the stirring wings 61 in the expanded form. As a result, the modified ground pillar 51 having a desired diameter can be precisely formed in the earthen foundation.

Figure 7:
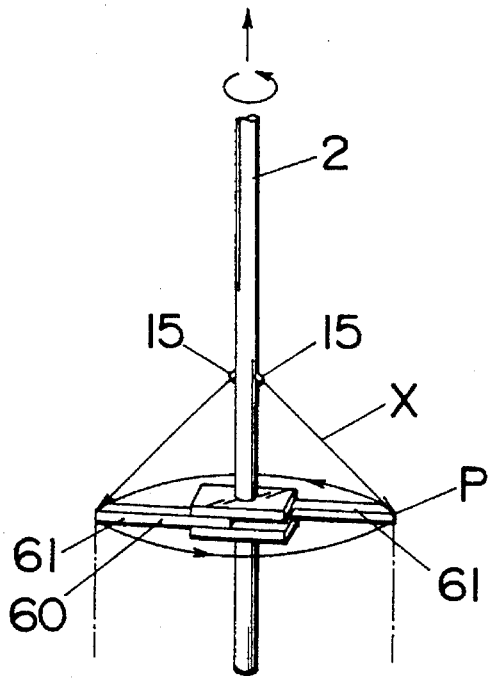
FIG. 7 is a perspective view showing a stirring and mixing range obtained when the auger shaft of FIG. 5 is rotated while jetting a consolidating fluid therefrom.
Figure 8:
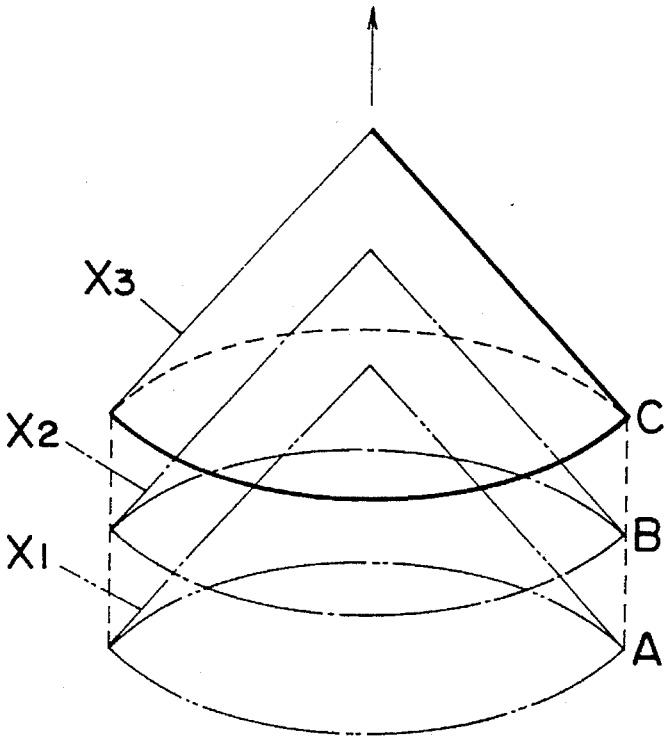
FIG. 8 is a diagram illustrating stirring and mixing ranges obtained when the auger shaft of FIG. 5 is withdrawn while rotating the auger shaft and jetting the consolidating fluid.

When the auger shaft 2 is rotated while jetting the consolidating fluid in a downwardly diagonal direction from the nozzles 15, traces of the consolidating fluid is provided with a curved surface of a conical shape X, as shown in FIG. 7. In comparison to the case of rotating an auger shaft while jetting the consolidating fluid in a substantially horizontal direction to obtain a two-dimensional stirring and mixing range, a stirring and mixing range obtained in the present invention becomes three-dimensional, thus providing effective stirring and mixing. As shown in FIG. 8, as the auger shaft 2 is withdrawn from the position "A" to the position "C", while rotating the auger shaft 2 and jetting the consolidating fluid from the nozzles 15, the three-dimensional (approximately conically shaped) stirring and mixing range shifts from X1 to X3. On the other hand, a circularly shaped stirring and mixing range is provided by rotating the auger shaft 2 while keeping the stirring wings 61 in the expanded form, as shown in FIG. 7. Therefore, a combination of these stirring and mixing ranges provides more effective stirring and mixing in the withdrawing step.

Figure 9:
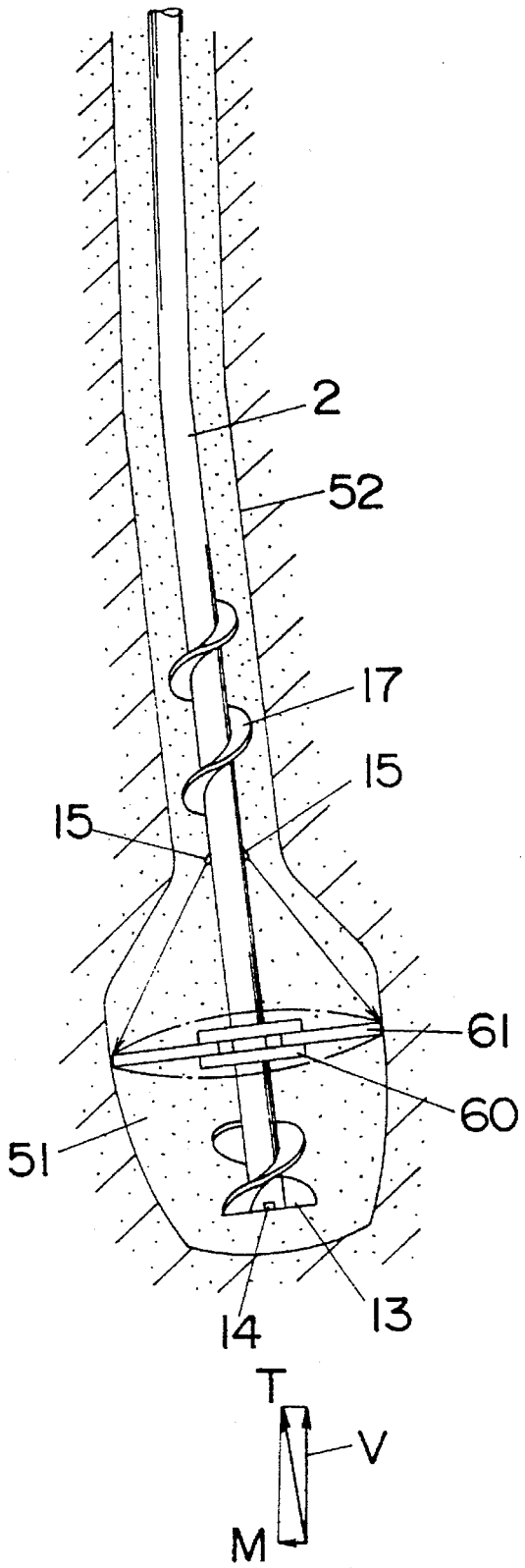
FIG. 9 is a diagram illustrating a self-recovery force occurring when the auger shaft of FIG. 5 in an inclined hole is withdrawn according to the present method.

By the way, in case of excavating the earthen foundation with the auger shaft 2, there causes a problem that the auger shaft 2 is often inserted in an inclined direction due to a contacting pressure between the bit 13 and the earthen foundation during the excavating step, so that an inclined hole 52 is formed in the earthen foundation. However, even when such an inclined hole 52 is formed by the excavating step, as shown in FIG. 9, a modified ground pillar having an improved vertical accuracy can be formed by the withdrawing step. That is, the auger shaft 2 is withdrawn away from the inclined hole 52 with a withdrawing force indicated by the arrow "T" of FIG. 9, while rotating the auger shaft 2, keeping the stirring wings 61 of the stirrer 60 in the expanded form, and jetting the consolidating fluid. Since the contacting pressure is released and the soil surrounding the inclined hole 52 is softened by the consolidating fluid jetted from the nozzles 15, a self-recovery force of the auger shaft 2 effectively operates in a direction indicated by the arrow "M" of FIG. 9. As a result, the auger shaft 2 elastically deformed in the inclined hole 52 rapidly can recover its original shape as soon as the withdrawing step starts. Subsequently, since the withdrawing step is continued while keeping the original shape of the auger shaft 2, the modified ground pillar can be formed perpendicularly in the earthen foundation irrespective of the inclined hole. The arrow "V" of FIG. 9 designates a vertical component of the withdrawing force "T".

<Second Embodiment>

Figure 17:
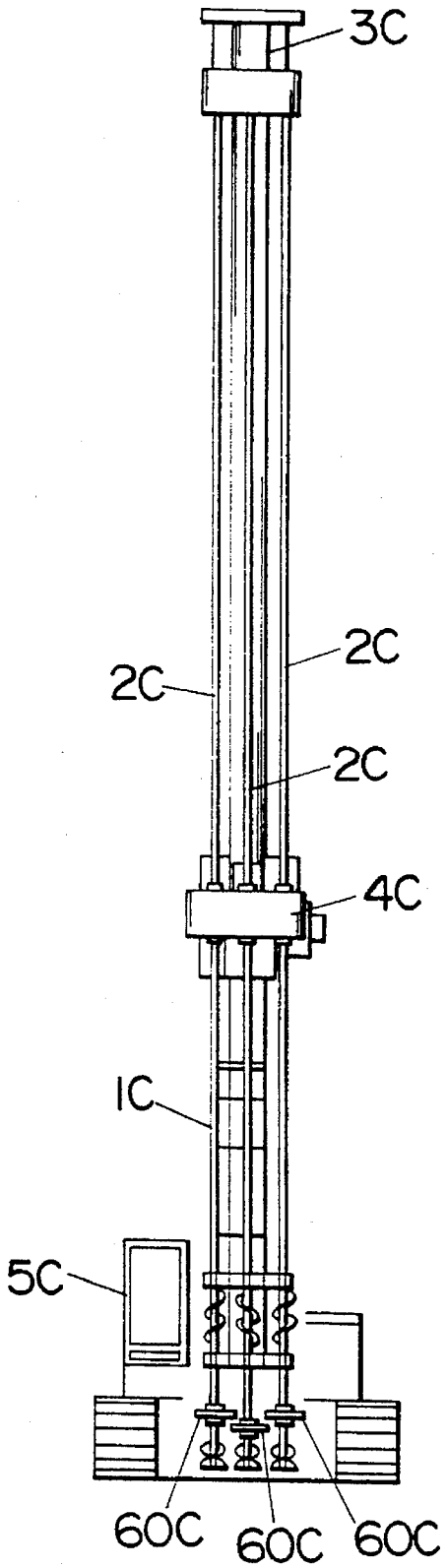
FIG. 17 is a front view of an excavator having a plurality of auger shafts used in a second embodiment of the present invention.
Figure 18:
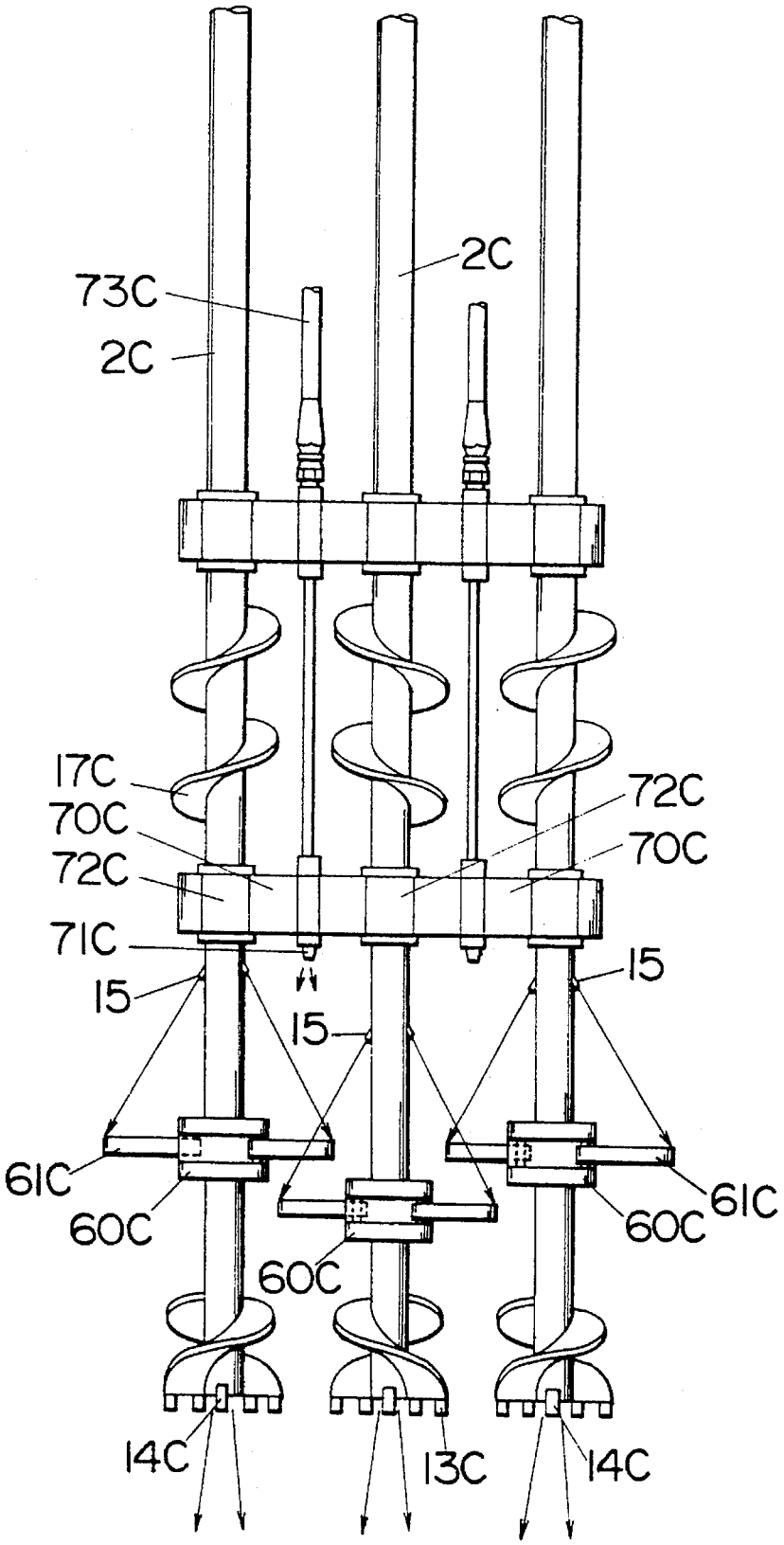
FIG. 18 is a front view of auger shafts of the present invention.
Figure 20:
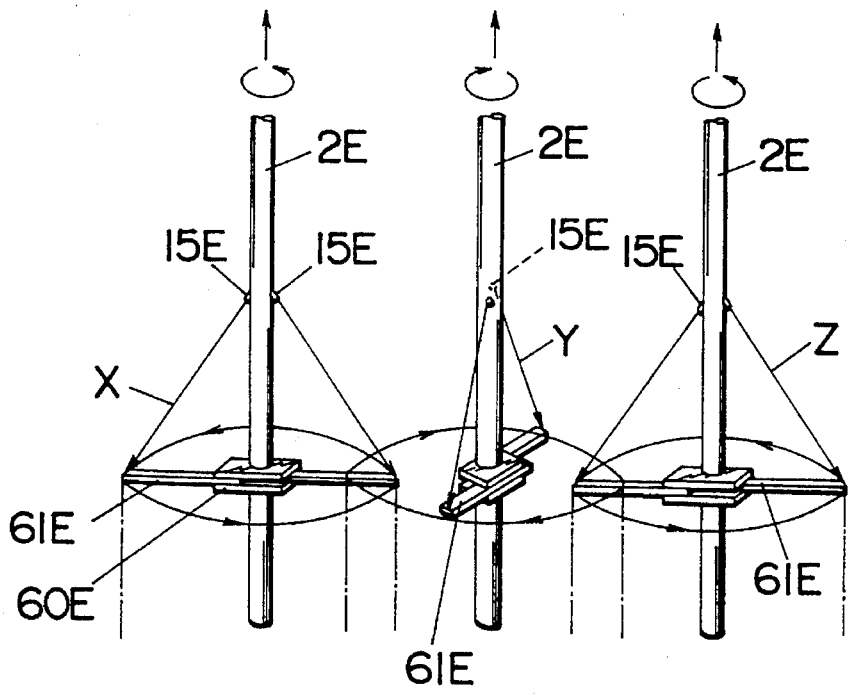
FIG. 20 is a perspective view showing stirring and mixing ranges obtained when the auger shafts of FIG. 18 are rotated while jetting a consolidating fluid therefrom.

For efficiently constructing a modified ground wall in an earthen foundation, it is preferred to use an excavator 1C having a plurality of auger shafts 2C, as shown in FIG. 17. Each of the auger shafts 2C is substantially equal to the auger shaft 2 of the first embodiment. That is, the auger shaft 2C is formed with a bit 13C, a nozzle 14C for jetting a fluid, a pair of nozzles 15C for jetting a consolidating fluid in a downwardly diagonal direction, a stirrer 60C having a pair of expandable stirring wings 61C, and a spiral screw 17C. The stirring wings 61C of the stirrer 60C are capable of selectively taking an expanded form and a reduced form to vary an outside diameter thereof about the axis of the auger shaft 2. The stirrer 60C is provided on the auger shaft 2C such that the consolidating fluid jetted from the nozzles 15C collides with the stirring wings 61C in the expanded form. The nozzles 15C and the stirrer 60C of each of the auger shafts 2C are axially staggered with those of an adjacent auger shaft 2C, as shown in FIG. 18, to prevent collision of the stirring wings 61C in the expanded form between the adjacent auger shafts 2C. In addition, the auger shafts 2C is rotated so as to prevent collision of the consolidating fluid between the adjacent auger shafts 2C. If necessary, it is possible to provide nozzles 15E and stirrers 60E to auger shafts 2E, as shown in FIG. 20. In this case, it is required to rotate the auger shafts 2E so as to prevent collision of stirring wings 61E in the expanded form between adjacent auger shafts 2E. Arrows in FIG. 18 designate jetting directions of the consolidating fluid and the fluid.

The auger shafts 2C pass through tie-beam members 70C which can be inserted into the earthen foundation together with the auger shaft 2C, as shown in FIG. 18. The tie-beam member 70C is useful for maintaining a distance between adjacent auger shafts 2C. Of course, the auger shafts 2C are rotatably supported by bearing portions 72C of the tie-beam member 70C. The tie-beam member 70C further includes a plurality of auxiliary nozzles 71C for jetting the fluid downwardly to facilitate the progress of the tie-beam member 70C into the earthen foundation. Numeral 73C designates a hose tube for supplying the fluid to the auxiliary nozzle 71C.

Figures 19A, 19B, 19C, 19D, 19E:
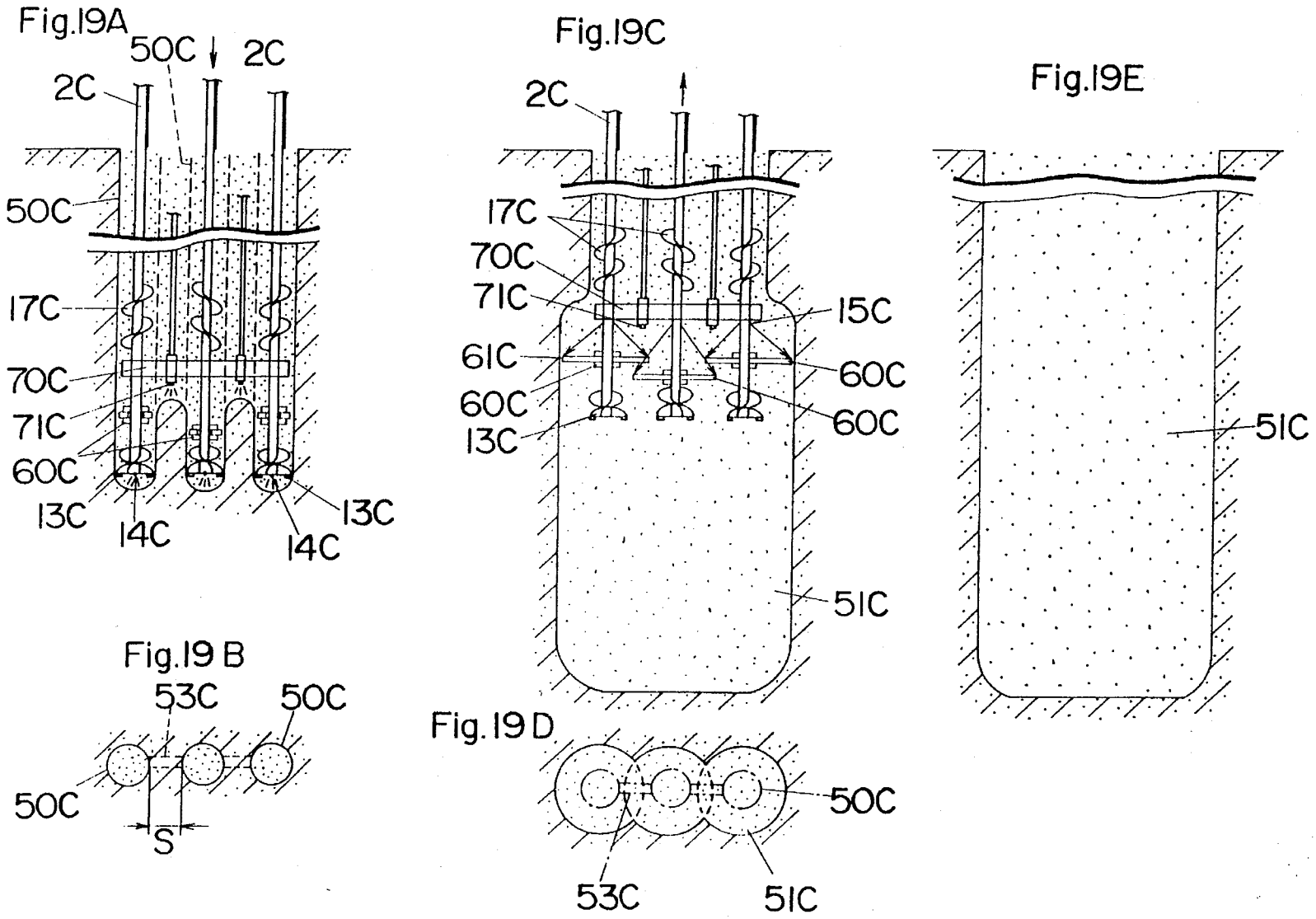
FIGS. 19A to 19E show a process of forming a modified ground wall in an earthen foundation with the use of the auger shafts of FIG. 18.

By the use of the auger shafts 2C, a modified ground wall 51C is efficiently formed in the earthen foundation in accordance with the following method of the present invention. That is, the method comprises an excavating step, as shown in FIGS. 19A and 19B, and a withdrawing step of the auger shafts 2C, as shown in FIGS. 19C to 19E. In the excavating step, the earthen foundation is excavated with the bits 13C of the auger shafts 20 to form therein holes 50C by rotating the auger shafts 2C while keeping the stirring wings 61C in the reduced form, and jetting the fluid from the nozzles 14C and the auxiliary nozzles 71C and without jetting the consolidating fluid from the nozzles 15C until the holes 50C having a predetermined depth are formed. Radiuses of gyrations of the bit 13C and the spiral screw 17C of each of thee auger shafts 2C are determined such that the hole excavated by the auger shaft 2C is not overlapped with that excavated by the adjacent auger shaft 2C, as indicated by the range "S" of FIG. 19B. Each of the holes 50C is connected with the adjacent hole by a rectangular hole 53C which is excavated by the fluid jetted from the auxiliary nozzle 71C, as shown in FIG. 19B.

Subsequently, the auger shafts 2C are withdrawn away from the bottoms of the holes 50C without jetting the fluid from the nozzles 14C and the auxiliary nozzles 71C and while rotating the auger shafts 2C, keeping the stirring wings 61C in the expanded form, and jetting the consolidating fluid from the nozzles 15C against soil surrounding the holes 50C for enlarging the diameter of the hole, so that a modified ground pillar formed by each of the auger shafts 2C is partially overlapped with the modified ground pillar formed by an adjacent auger shaft 2C in order to form the modified ground wall 51C, as shown in FIG. 19D. The modified ground wall 51C is utilized as an underground water cut-off wall, landslide protection wall, a foundation pile or the like, and for reinforcing a soft ground.

Figure 21:
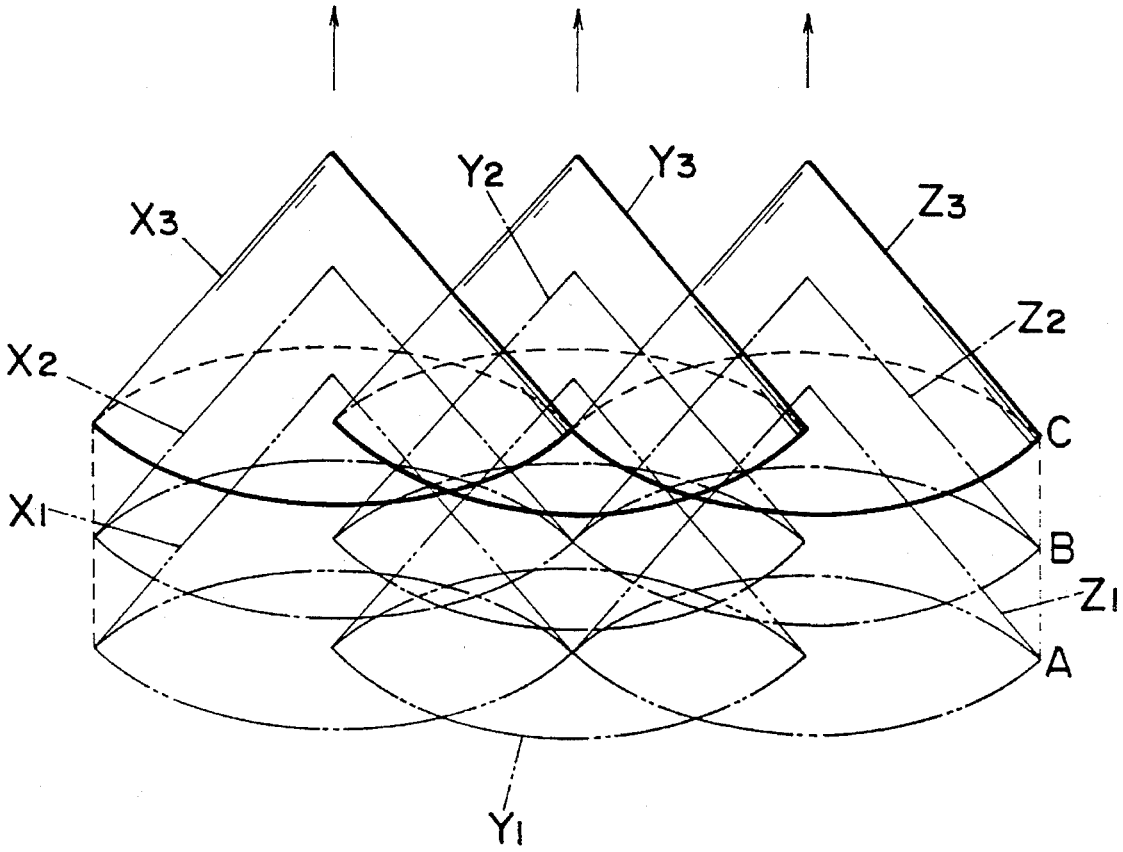
FIG. 21 is a diagram illustrating stirring and mixing ranges obtained when the auger shafts of FIG. 18 are withdrawn while rotating the auger shafts and jetting the consolidating fluid.
Figure 22:
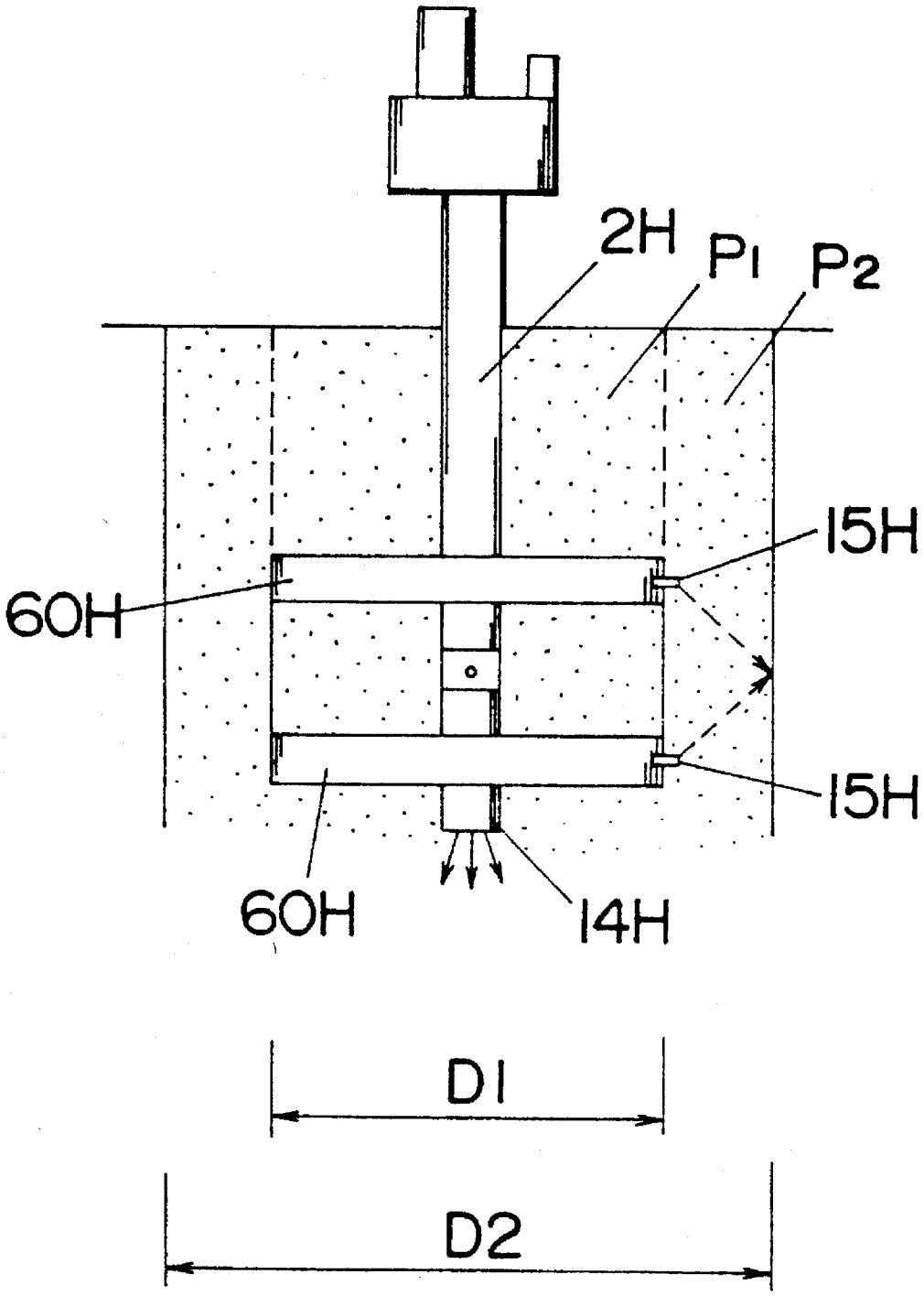
Fig.22(PRIOR ART)
FIG. 22 is a front view of a rotary shaft of the prior art.

As shown in FIG. 20, in case of rotating the auger shafts 2E, while jetting the consolidating fluid in a downward diagonal direction from the nozzles 15E, traces of the consolidating fluid jetted from the nozzles 15E of the auger shafts 2E are provided with curved surfaces of conical shapes (X, Y and Z). A three-dimensional (approximately conically shaped) stirring and mixing range given by the consolidating fluid jetted from the nozzles 15E and the stirring wings 61E of each of the auger shafts 2E is partially overlapped with the stirring and mixing range of an adjacent auger shaft 2E. In this case, each of the auger shafts 2E is rotated in the opposite direction to the adjacent auger shaft 2E. As the auger shafts 2E are withdrawn from the position "A" to the position "C", while rotating the auger shafts 2E and jetting the consolidating fluid, as shown in FIG. 21, the stirring and mixing ranges shift from X1 to X3, Y1 to Y3 and Z1 to Z3, respectively, thus providing effective stirring and mixing.

In the above explained embodiments, it is preferred to adopt a consolidating fluid including a reinforcing fiber from the viewpoint of the strength of the modified ground pillar or wall of the present invention. The fiber is selected from a steel fiber, a synthetic resin, and a mixture thereof. For example, a length and diameter of the reinforcing fiber are selected from the ranges of 3 to 6 cm, and 0.3 to 1.5 mm, respectively.

What is claimed is:

1. An excavator having at least one rotary shaft for forming a modified ground in an earthen foundation, said rotary shaft comprising:

excavating means provided at a bottom end of said rotary shaft;

stirring means having at least one expandable stirring wing disposed upwardly of said excavating means, said stirring wing being capable of selectively taking an expanded form and a reduced form to vary an outside diameter of said stirring means about the axis of said rotary shaft; and at least one nozzle for jetting a consolidating fluid in a downwardly diagonal direction, which is disposed upwardly of said stirring means such that said consolidating fluid jetted from said nozzle collides with said stirring wing in said expanded form.

2. A method of forming said modified ground in the earthen foundation with the use of said excavator as set forth in claim 1, said method comprising the steps of:

excavating the earthen foundation with said excavating means to form therein a hole by rotating said rotary shaft while keeping said stirring wing in said reduced form without jetting said consolidating fluid from said nozzle until said hole is excavated to reach a predetermined depth; and withdrawing said rotary shaft away from the bottom of said hole while rotating said rotary shaft, keeping said stirring wing in said expanded form, and jetting said consolidating fluid from said nozzle against soil surrounding said hole to break the same for enlarging the diameter of said hole in such a manner as to perform an in-situ mixing and stirring of said consolidating fluid and soil, whereby forming said modified ground having a larger diameter than said hole.

3. A method as set forth in claim 2, wherein said excavator has a plurality of said rotary shafts.

4. A method as set forth in claim 3, wherein said excavating step is performed without overlapping said hole excavated by each of said rotary shafts with said hole excavated by an adjacent rotary shaft.

5. A method as set forth in claim 3, wherein said withdrawing step is performed such that a stirring and mixing range given by said consolidating fluid jetted from said nozzle and said stirring wing in said expanded form of each of said rotary shafts is partially overlapped with the stirring and mixing range of an adjacent rotary shaft.

* * * * *